US007845364B2

(12) United States Patent
Tolmie

(10) Patent No.: US 7,845,364 B2
(45) Date of Patent: Dec. 7, 2010

(54) PORTABLE, RETRACTABLE GOLF SHELTER

(76) Inventor: Brian Tolmie, 9037 NE. 16th St., Bellevue, WA (US) 98004

( * ) Notice: Subject to any disclaimer, the term of this patent is extended or adjusted under 35 U.S.C. 154(b) by 904 days.

(21) Appl. No.: 10/794,950

(22) Filed: Mar. 5, 2004

(65) Prior Publication Data

US 2004/0261328 A1 Dec. 30, 2004

Related U.S. Application Data

(60) Provisional application No. 60/483,131, filed on Jun. 27, 2003.

(51) Int. Cl.
*E04H 15/06* (2006.01)

(52) U.S. Cl. ..... 135/88.01; 135/900; 135/912

(58) Field of Classification Search ..... 135/88.01, 135/88.04, 88.1, 900, 912, 133, 122, 88.02, 135/88.03; 473/421, 446, 478; 273/400; 280/47.131, 47.17, 47.2, 47.24, 63
See application file for complete search history.

(56) References Cited

U.S. PATENT DOCUMENTS

| | | | | | |
|---|---|---|---|---|---|
| 202,748 | A | | 4/1878 | Overfield | |
| 2,571,037 | A | * | 10/1951 | Hoffman | 5/128 |
| 2,575,572 | A | | 11/1951 | Wickstrum | 135/4 |
| 2,923,547 | A | * | 2/1960 | Heeremans | 473/421 |
| 3,774,930 | A | * | 11/1973 | Pravednekow | 280/47.24 |
| 3,860,236 | A | | 1/1975 | Buchanan | 273/35 B |
| 4,106,520 | A | | 8/1978 | Warner et al. | 135/4 R |
| 4,239,247 | A | | 12/1980 | Hinz | 280/12 |
| 4,343,487 | A | * | 8/1982 | Crothers | 280/654 |
| 4,630,627 | A | * | 12/1986 | Windows et al. | 135/122 |
| 4,870,984 | A | * | 10/1989 | Roth | 135/148 |
| 4,889,342 | A | | 12/1989 | Hugunin | 273/176 |
| 4,957,306 | A | * | 9/1990 | Greenberg | 280/652 |
| 4,958,846 | A | * | 9/1990 | Greenberg | 280/652 |
| 5,011,152 | A | | 4/1991 | Hugunin | 273/176 |
| 5,226,264 | A | * | 7/1993 | Walters | 52/63 |
| 5,277,214 | A | | 1/1994 | Tolley | 135/109 |
| 5,575,301 | A | | 11/1996 | Bolton | 135/122 |
| 5,634,638 | A | * | 6/1997 | Havens et al. | 473/421 |
| 5,655,559 | A | | 8/1997 | Zembik et al. | 135/132 |
| 5,690,134 | A | | 11/1997 | McCauley | 135/133 |
| 6,022,032 | A | * | 2/2000 | Savage | 280/47.24 |
| 6,050,577 | A | * | 4/2000 | Smith | 280/47.24 |

(Continued)

*Primary Examiner*—David Dunn
*Assistant Examiner*—Noah Chandler Hawk
(74) *Attorney, Agent, or Firm*—Dean A Craine

(57) ABSTRACT

A portable golf shelter that protects one golfer from inclement weather as he or she swings a golf club or practices their putting, chipping, or pitching. The golf shelter comprises a three-sided frame with at least one pair of wheels mounted on the opposite side frames. The frame is made of lightweight material and the wheels are mounted on the side frames so that the front edges of the two side frames can be easily lifted by one person forcing the rear frame downward with light pressure. When the rear frame is forced downward and the front edges are lifted, the shelter can be easily moved on its wheels to different locations on the golf course. An optional rearward extending handle is mounted on the rear frame member to assist the person while moving the shelter. The shelter also includes a lightweight retractable roof that may be folded downward to reduce the shelter's overall side profile. When the roof is extended, the space inside the shelter is sufficient to allow a golfer and instructor to stand and swing a golf club unencumbered.

13 Claims, 10 Drawing Sheets

U.S. PATENT DOCUMENTS 6,367,496 B1 4/2002 Rempel et al. ..... 135/122
6,397,870 B1 * 6/2002 Makedonsky et al. ..... 135/116
6,453,922 B1 * 9/2002 Dufort ..... 135/117
6,637,761 B1 * 10/2003 Boettcher ..... 280/47.24

* cited by examiner 190
154

150

116
114
190
154

112
111
110

PORTABLE, RETRACTABLE GOLF SHELTER

This utility patent application is based on the provisional patent application (Ser. No. 60/483,131) filed on Jun. 27, 2003.

BACKGROUND OF THE INVENTION

1. Field of the Invention

The present invention relates to portable shelters, and more particularly to shelters used to protect golfers while swinging at golf balls from the sun, rain, and wind.

2. Description of the Related Art

It is common for a golfer to hire a golf instructor to watch and critique their golf swing. Unfortunately, many golfers find hiring a golf instructor embarrassing and prefer the instruction be given privately in a secluded area on the golf course.

Protective shelters used at golf driving ranges to protect golfers from the sun and rain are relatively common. For example, U.S. Pat. No. 5,967,162 discloses a relatively large shelter capable to being used at a golf driving range that includes a canopy support section mounted on two triangular supports. Each support includes two wheels that enable the shelter to be moved to different locations on the golf driving range. The mobile shelter is relatively large so that a large number of golfers may use the shelter at one time. The mobile shelter's frame is relatively heavy to prevent wind induced lift.

U.S. Pat. No. 6,367,496 discloses a portable, lightweight driving range shelter designed to be held down with ground anchors during high wind conditions. The shelter includes a frame having front and back arches joined by two skids at their bottom ends and a set of braces extending between the arches. While this shelter may be easier to transport than the shelter disclosed in U.S. Pat. No. 5,967,162, it is not designed to be assembled and disassembled between uses or after a rain storm.

What is needed is a portable shelter for a golfer and an instructor that provides privacy and protection against inclement weather. Such a shelter should be relatively small and lightweight thereby enabling it to be easily moved from a main storage area to a golf course or driving range. It should also be quickly assembled and dissembled so it may be used during changing weather conditions. It should also be relatively compact and have a low profile when placed in storage.

SUMMARY OF THE INVENTION

It is an object of the present invention to provide a portable golf shelter that provides privacy to one golfer and a golf instructor.

It is another object of the present invention to provide such a portable golf shelter that protects the user from inclement weather while swinging a golf club.

It is a further object of the present invention to provide such a portable golf shelter that can be quickly and easily assembled and disassembled after changing weather conditions.

It is a still further object of the invention to provide such a golf shelter that can be disassembled into a compact, low profile configuration.

These and other objects of the present invention are met by a portable golf shelter that protects golfers from inclement weather as they swing a golf club or practice their putting. The golf shelter includes a retractable roof mounted on a lightweight, three-sided lower frame. The roof includes a plurality of pivoting roof sections joined at their adjacent edges. The lower frame includes at least two wheels mounted on opposite side frame members with an optional second pair of wheels mounted on the front edge of each frame member. Mounted on the rear frame member is a rearward extending handle that enables one person to press downward and lift the front edges of the two side frame members off the ground so that the shelter may be easily moved to different locations on a golf course or driving range. When the roof is retracted on the frame, the side profile of the shelter is reduced thereby enabling the shelter to be partially hidden from view when not in use. When the roof is extended over the frame, the area inside the shelter is sufficient in size to allow a golfer to stand inside the shelter and swing a golf club.

When two front wheels are not attached to the side frame members, two spike receiving tongues are attached to the front edges of the two side frame members. A pivoting support leg is mounted on the rear frame member that extends downward to hold the rear frame member in an elevated position over the ground. Two stakes are provided with the device that are designed to be driven through the receiving tongues and into the ground to securely hold the front edges on the two side frame members on the ground in windy weather.

In the preferred embodiment, the material used to cover the two side frames, the rear frame member, and the roof sections may be made of vinyl or nylon sheet or mesh.

DESCRIPTION OF THE PREFERRED EMBODIMENT(S)

Figure 1:
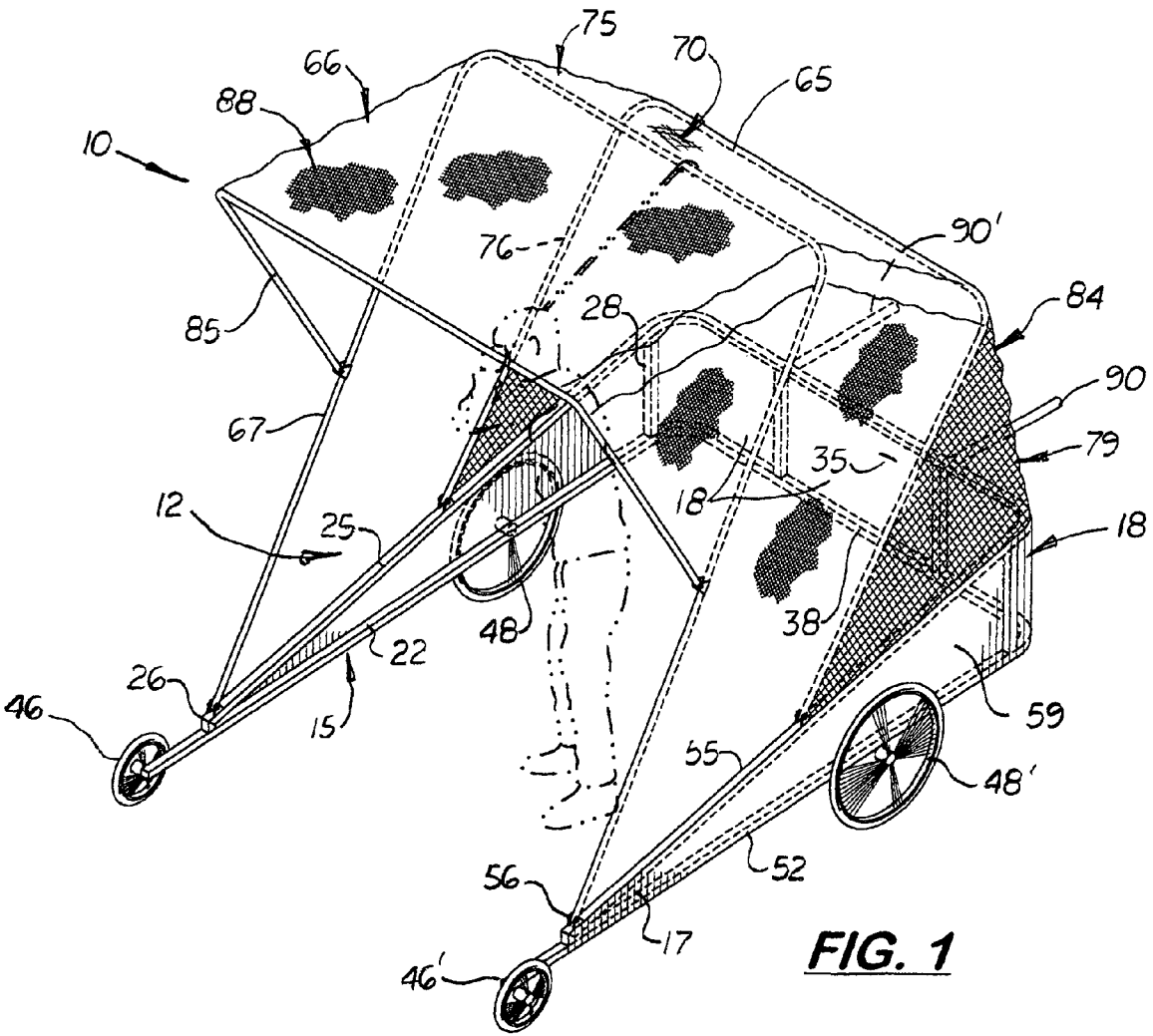
FIG. 1 is a perspective view of a golfer standing inside an assembled golf shelter disclosed herein.

Referring to the FIGS. 1-5, there is shown a portable golf shelter, generally indicated by 10 designed to protect a golfer 95 from inclement weather as he swings a golf club or practices his putting, chipping or pitching. The shelter 10 includes a retractable roof 65 comprising several roof sections 66, 75, and 84 joined at their adjacent edges. The retractable roof 65 is mounted on a three sided lower frame 15 that includes two side walls 16, 17 and one end wall 18. Formed on the shelter 10 is a front opening 12 that a golf ball travels through.

Figure 2:
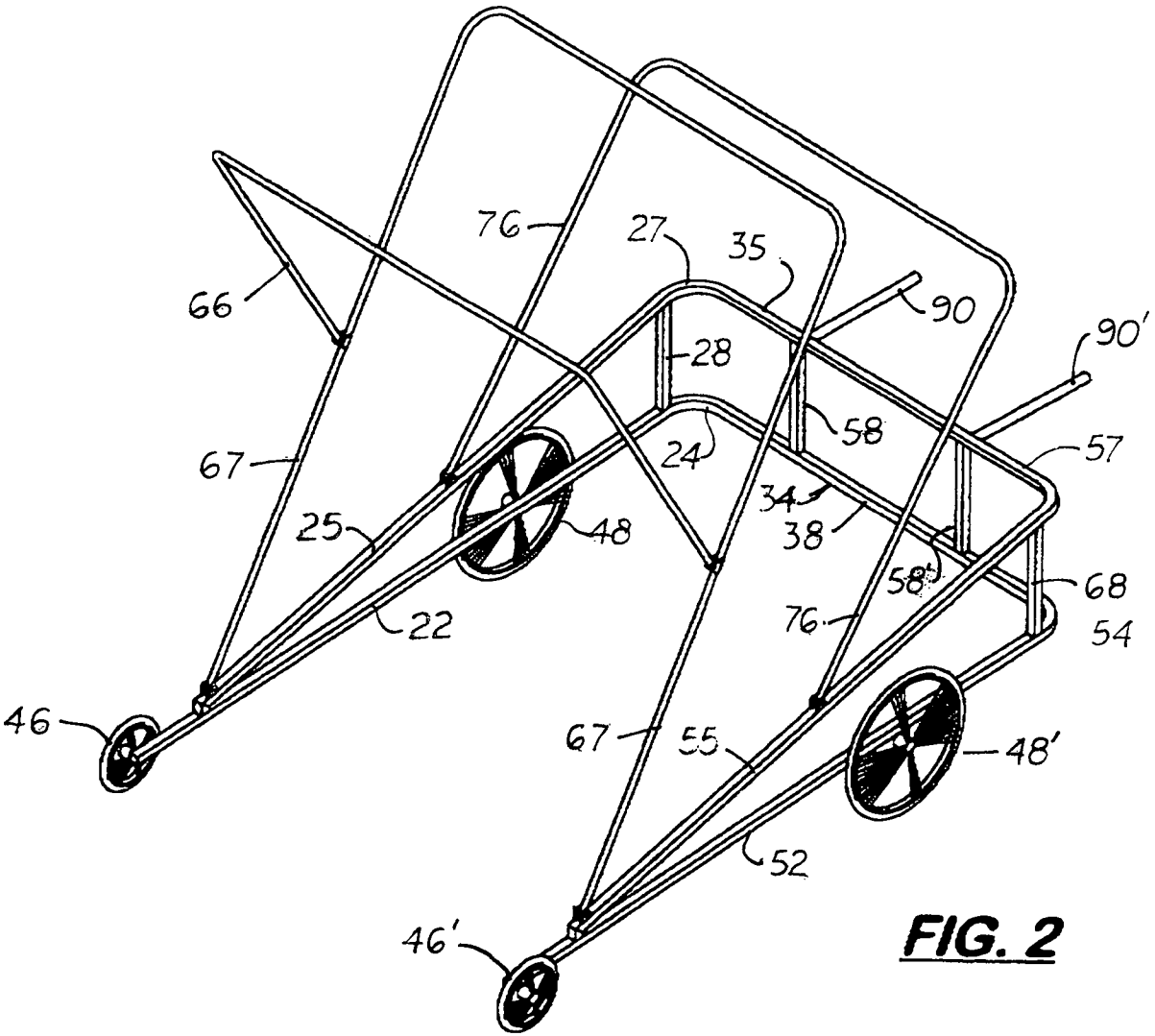
FIG. 2 is a perspective view shelter with two pairs of wheels mounted on opposite sides of the side frames with the three roof frame members shown in an extended position over the lower frame.
Figure 3:
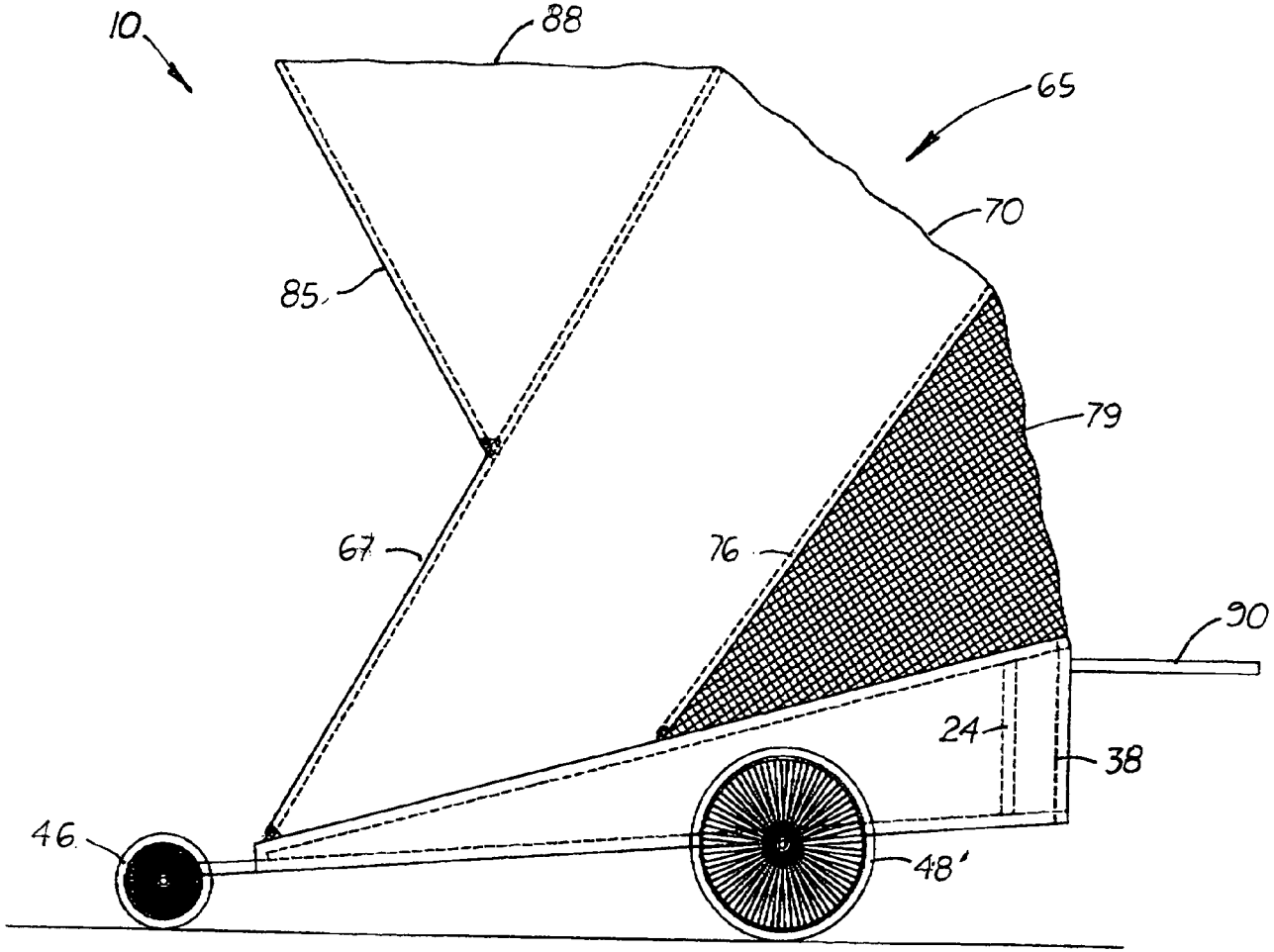
FIG. 3 is a side elevational view of the golf shelter shown in FIGS. 1 and 2.
Figure 4:
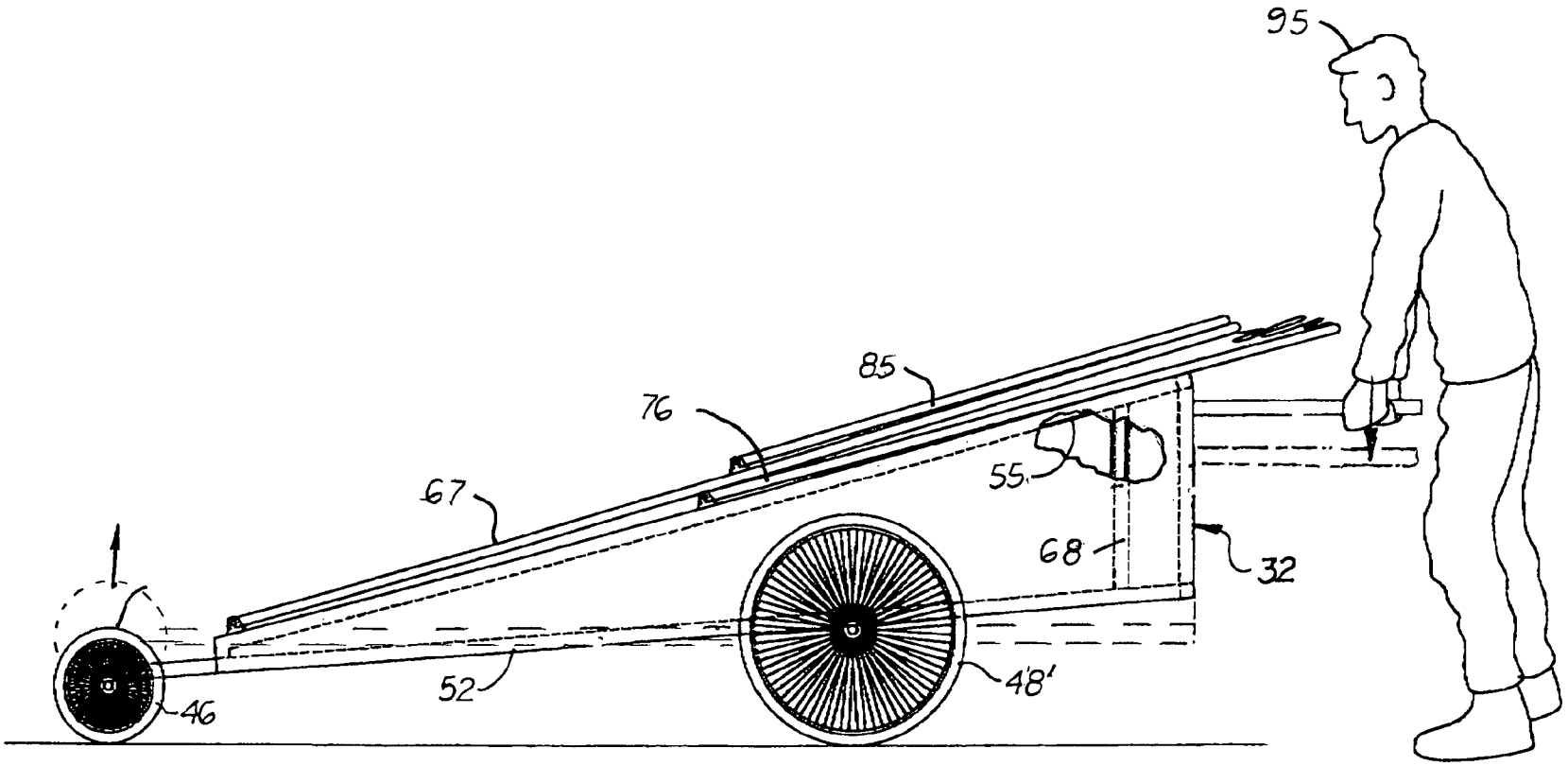
FIG. 4 is a side elevational view of one worker forcing the end of the rear side frame downward to lift the front edges of the two side frame members to easily move the golf shelter to a new location.

As shown in FIG. 2, the left and right side walls 16 and 17 include a side frame 21, 51 respectively. The side frames 21, 51 each include a longitudinally aligned lower member 22, 52, a diagonally aligned upper member 25, 55 and a plurality of intermediate members 28, 68, respectively, that extend between the lower and upper members. The lower member 22 and upper member 25 are joined together at their front ends 23, 26. The lower member 52 and upper member 55 are joined together at their front ends 53, 56. The end frame 34 includes a lower and upper transverse member 35, 38 and two vertically aligned members 58, 58'. The ends of the lower transverse member 35 are connected to the rear ends 24, 54 of the lower members 22, 52 while the ends of the upper transverse member 35 are connected to the rear ends 27, 57 of the upper members 25, 55 on the right and left side frames 21, 51, respectively.

In the first embodiment, two ten inch diameter front wheels 46, 46' are attached to the front ends of each side frame 21, 51, respectively, and two twenty-four inch diameter wheels 48, 48' are attached to each side frame 21, 51, respectively, at or near the mid-line axis thereof.

Attached to the upper transverse member 35 on the end frame 34 are two rearward extending handles 90, 90'. In the first embodiment, the handles 90, 90' are straight rods spaced apart so that the user may easily force the handles 90, 90' downward to lift the front wheels 46, 46' off the ground to turn and move the shelter 10.

As mentioned above, the retractable roof 65 comprises three roof sections 66, 75, 84 that extend transversely over the lower frame 15. The roof 65 includes a roof frame made up of three U-shaped roof supports 67, 76, 85 that support three roof sections 66, 75, 84. The first roof support 67 extends upward and rearward over the lower frame 15. The lower ends of the first roof support 67 are pivotally attached to the front ends 26, 56 of the upper members 25, 55, respectively. The second roof support 76 is slightly smaller than the first roof support 67 and also extends upward and rearward over the lower frame 15. The lower ends of the second roof support 76 are pivotally attached to the upper member 25, 55, at or near their mid-line axis. The third roof support 85 extends upward and forward over the lower frame 15 and pivotally connects at its opposite ends to the mid-line axis of the first roof support 67.

In the first embodiment, a first roof panel 70 is disposed between the first and second roof supports 67, 76, respectively. The opposite lower edges of the first roof panel 70 are connected to the upper members 25, 55 on the left and right side frames 21, 51, respectively. A second roof panel 79 is disposed between the second roof support 76 and the upper member 38 on the end frame 34. The lower edges of the second roof panel 79 extend downward over the side frames 21, 51 and may also be connected to the upper members 25, 55 on the left and right side frames 21, 51, respectively. A third roof panel 88 is disposed between the first and third roof supports 67, 85, respectively. The front edge of the third roof panel 88 is securely connected to the third roof support 85.

Figure 13:
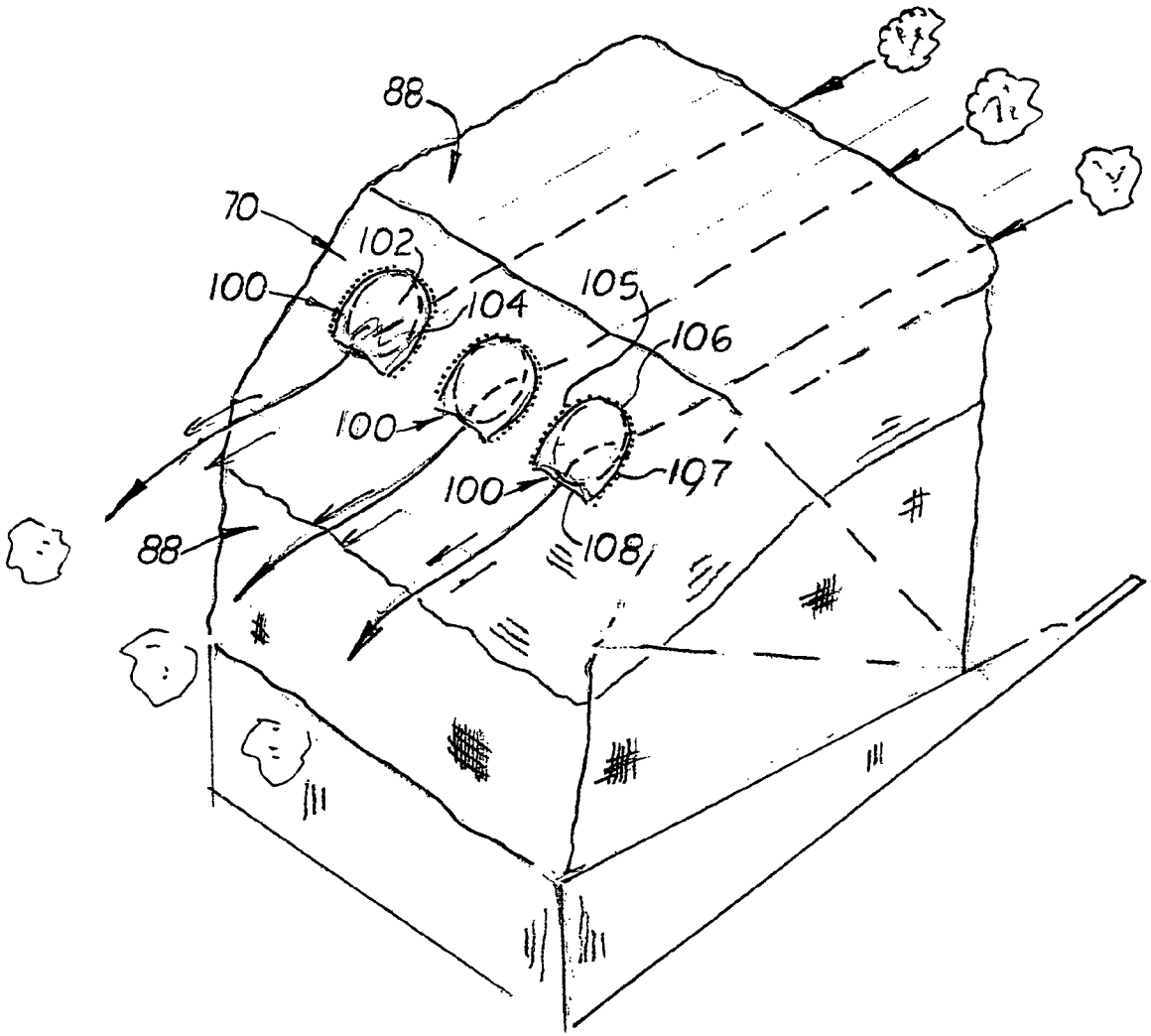
FIG. 13 is a perspective view of the second embodiment of the invention showing the air vents located on the roof panel.

The first, second, and third roof panels 70, 79, 88 are sewn or adhesively connected together at their adjacent edges to form one large roof 65. During manufacturing, the adjacent edges of the roof panels 70, 79, and 88 are aligned and attached to the roof supports 67, 76, and 85, respectively, so that the roof 65 may be manually extended or retracted by moving the roof supports 67, 76, 85 over the lower frame 15. As shown in FIG. 13, optional air vents 100 may be formed in one or more roof panels 70, 79, 88. The air vents 100 include an opening 102 formed in the roof panel (second roof panel 79 shown) with an outer flap 104 aligned and registered over the opening 102. The flap 104 is sewn along three edges 105, 106, 107 with lower edge 108 being detached so that air may flow into the shelter 10.

FIGS. 7-12 discloses a second embodiment of the shelter 10' in which the front wheels have been replaced with front extensions 110 that receives a stake 112 to connect the front edges of the shelter 10' to the ground. Shelter 10' also includes two optional weights 117 approximately 7 to 12 lbs/each used to hold the shelter 10' on the ground during higher wind conditions. Shelter 10' also includes two optional front tightening straps 116 that connect the front edge of the third roof section to an eyelet 114 attached to the lower frame to prevent the roof from retracting during high wind conditions.

Figure 6:
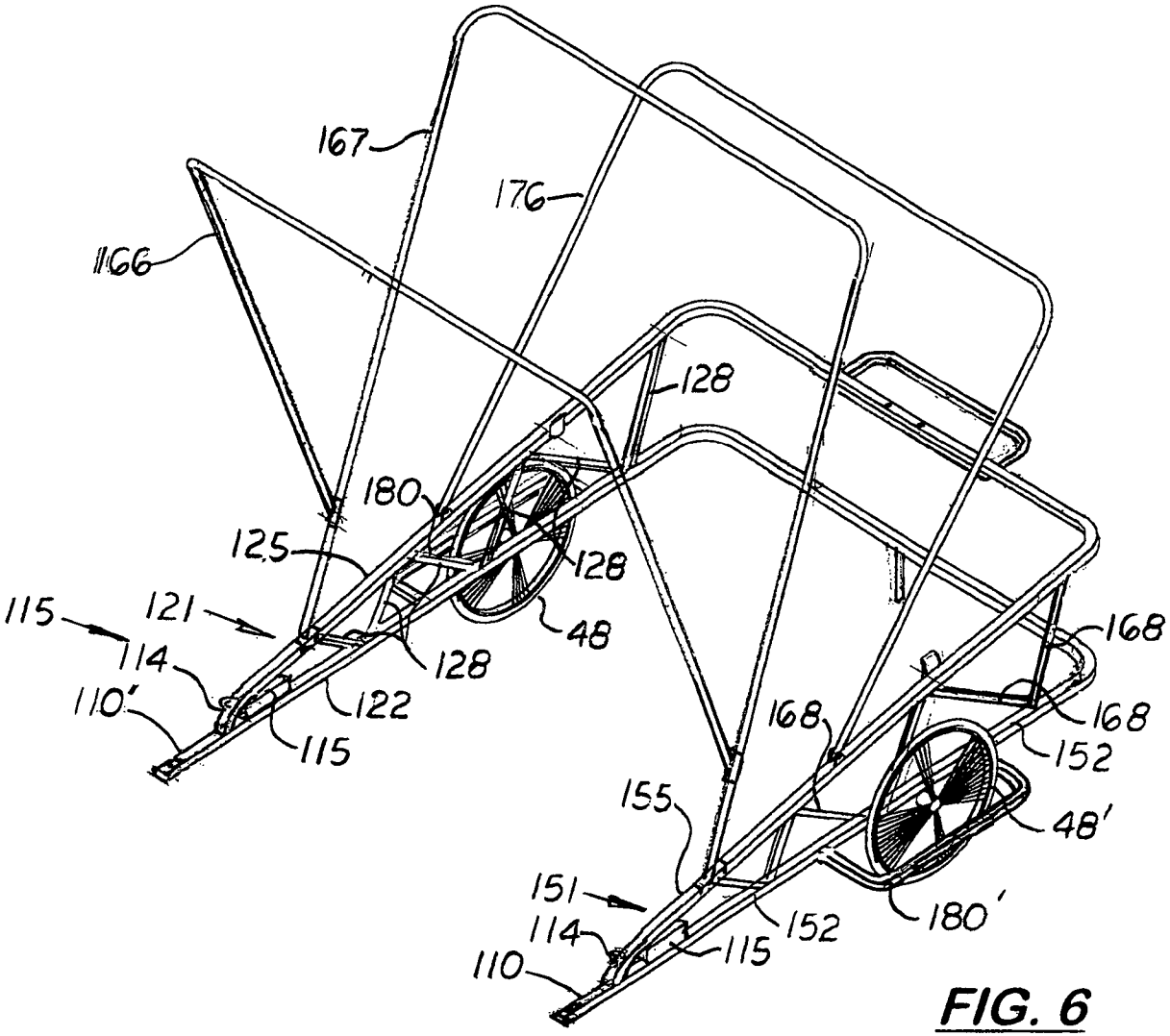
FIG. 6 is a perspective view of the frame used with the second embodiment of the invention shown in FIG. 5.

As shown in FIG. 6, the lower frame on shelter 10' includes two side frames 121, 151 each comprising a lower member 122, 152 and a diagonally aligned upper member 125, 155, respectively. The distal end of each diagonal upper member 125, 155 curves downward and connects to the lower member 122, 152, respectively, approximately 12 to 18 inches from the distal end of the extensions 110, 110'. Formed near the distal end of each extension 110, 110' is a hole 111, 111', (one shown, see FIG. 9) respectively, through which a stake 112 may extend. During use, the stake 112 extends through the hole 111 and driven into the ground to hold the shelter 10' on the ground.

The two side frames 121, 151 include a plurality of diagonally aligned brace members 128, 168, respectively, to provide additional support.

Figure 5:
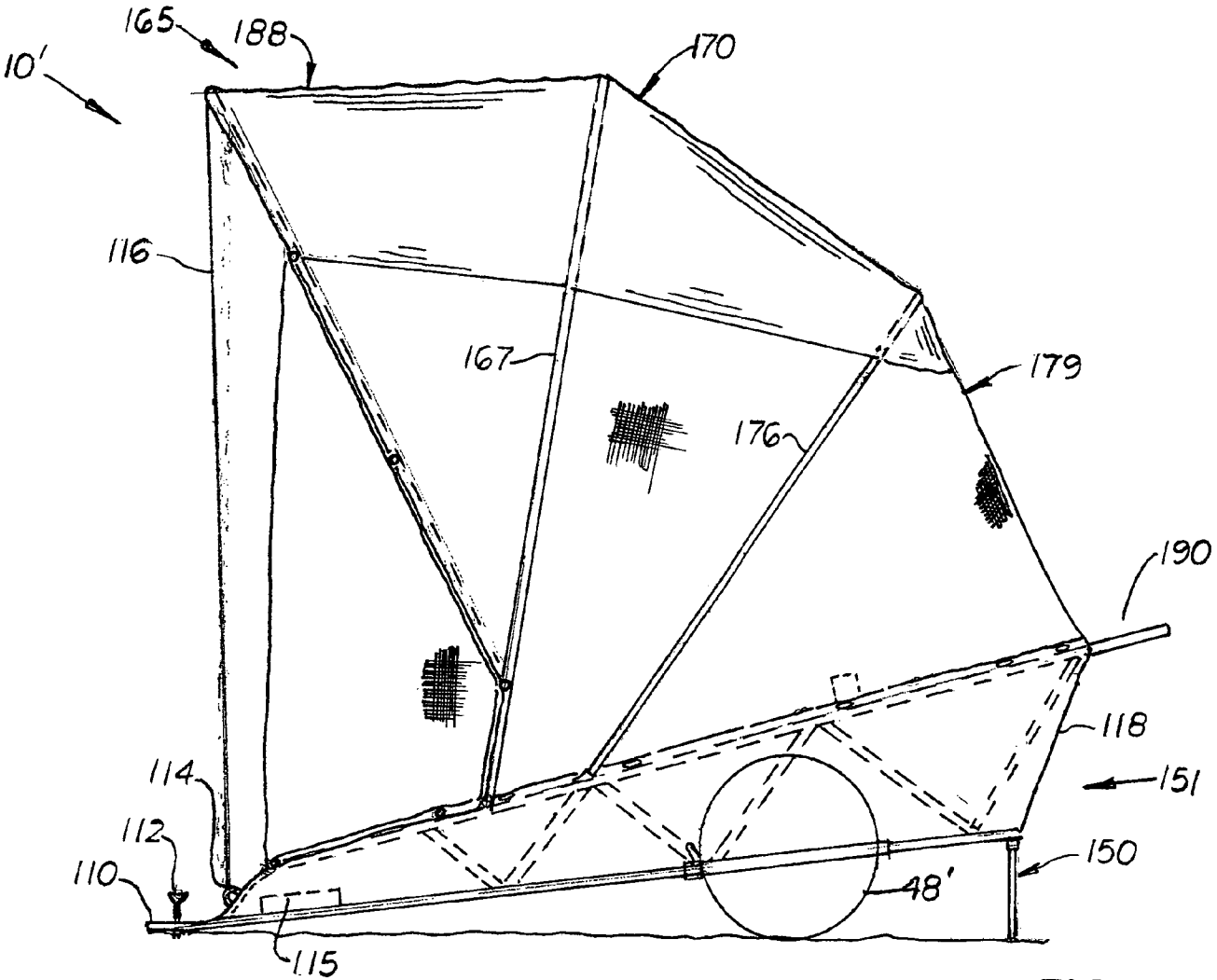
FIG. 5 is a second embodiment of the golf shelter with an alternative retractable frame and the two front wheels replaced with two spike receiving tongues with two spikes being used to hold the two spike receiving tongues on the ground.
Figure 7:
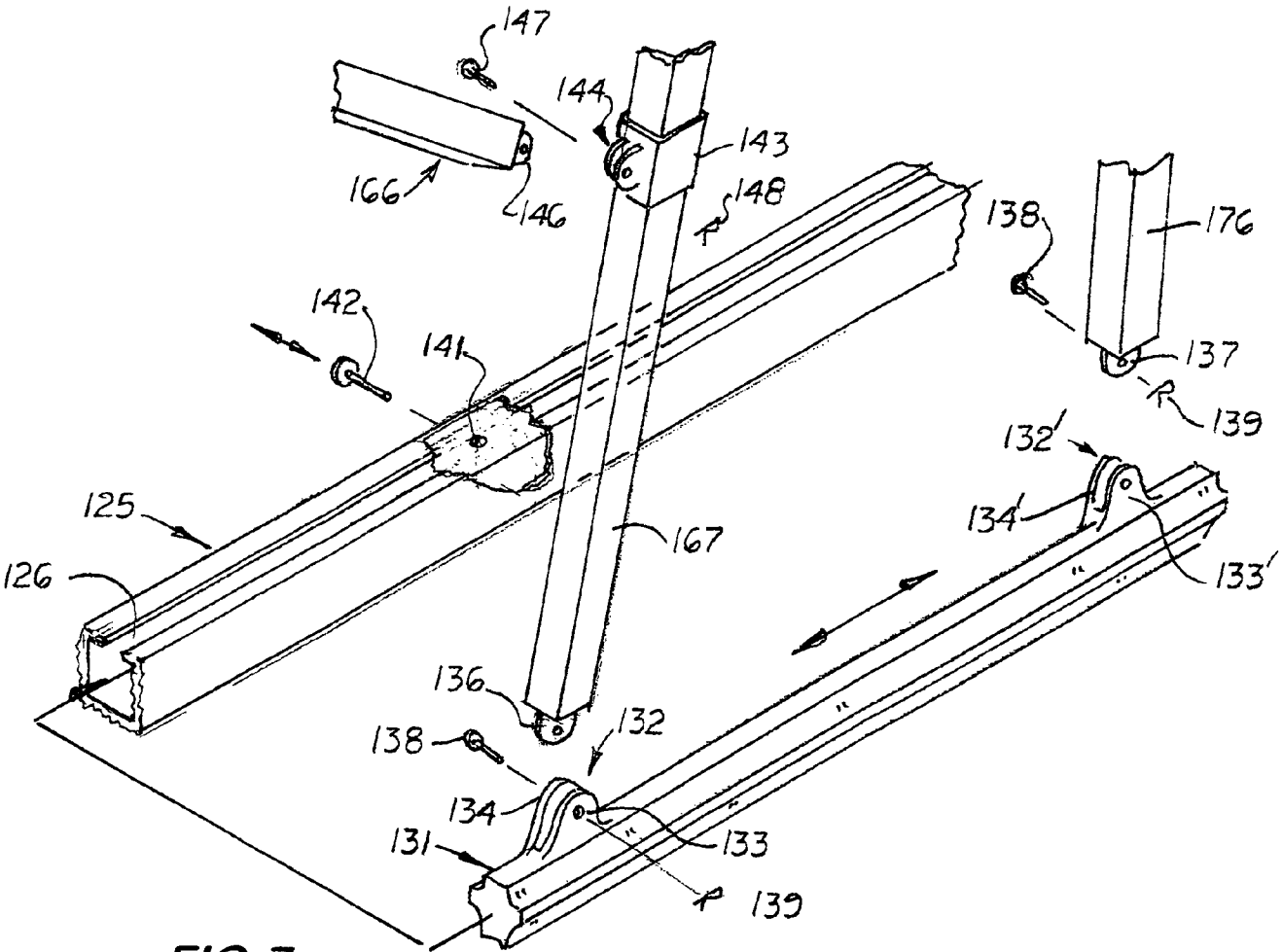
FIG. 7 is a partial perspective view of the folding top rail members of the frame.

The retractable roof 165 used in shelter 10' shown in FIGS. 5-6 is nearly identical to the retractable roof 65 used with shelter 10 except for the arrangement of the roof supports 166, 167, 176 and their method of attachment to the lower frame 115. In shelter 10', the diagonal members 125, 155 are hollow channels with longitudinally aligned slot 126, respectively, formed therein as shown in FIGS. 6, 7. Disposed inside the upper member 125 is a sliding adapter 131 with two brackets 132, 132' formed on its opposite ends. Each bracket 132, 132' includes two arms 133, 134 and 133', 134', respectively, spaced apart designed to receive a tongue 136, 137 attached to the distal ends of the first and second supports 167, 176. During assembly, the tongues 136, 137 on the first and second supports 167, 176, respectively, are extending to the brackets 132, 132' and connected thereto with a removable bolt 138 and counter pin 139. During assembly, the sliding adapter 131 is inserted into the upper member 125 so that the brackets 132, 132' extend through the slot 126. The side frames 121 and 151 are then assembled so that the brackets 132, 132' extend upward. After the lower frame 115 is completed, the tongue 136 on the first support 167 is connected to the first bracket 132. The tongue 137 on the second support 176 is then connected to the second bracket 132'. During use, the adapter 131 slides forward in the upper member 125 so that the first and second supports 167, 176 may pivot downward into a stacked, longitudinal position over the adjacent upper member 125. When the roof is extended, the roof supports 167, 176 are lifted and pulled forward thereby forcing the adaptor 131 in a forward direction inside the upper member. Formed on the inside surface of the upper member 125 is a hole 141 that receives a locking pin 142. The hole 141 is located at a position on the upper member 125 so that the locking pin 142 blocks forward movement of the adapter 131 when the roof supports 167, 176 are pulled into an extended position.

The first and second roof supports 167, 176 used with the shelter 10' are identical to the first and second roof supports 67, 76 used with the shelter 10. The third roof support 167 used with the shelter 10' is also U-shaped however longer in length so that it may attach to the lower section on first roof support 167. A bracket 143, similar to brackets 132, 132', is fixed in position on the first roof support 167. Bracket 143 includes an arm 144 that attaches to the tongue 146 attached to the distal end of the third roof support 166. A bolt 147 and pin 148 is used to hold the tongue 146 on the arm 144.

Because the distal ends of the extensions 110, 110' are supported on the ground, the end wall 118, is elevated above the ground. An optional support leg 150 is attached to the lower frame member. As shown in FIG. 5, the support leg 150 is pivotally mounted so that it may fold upward when the shelter 10' is moved and folded downward to support the rear wall in an elevated position. In the preferred embodiment, the support leg 150 is made of aluminum tubing approximately ¾ inches in diameter and 18 to 20 inches in length.

A U-shaped handle 190 is used in place of handles 90, 90'. The handle 190 is longitudinally aligned with the diagonal upper frame member 154. As noted above, and as shown in FIG. 4, during use the user forces the handle 190 downward to lift the extension (not shown) off the ground so that the shelter is fully supported by the two rear wheels 48, 48'.

Figure 8:
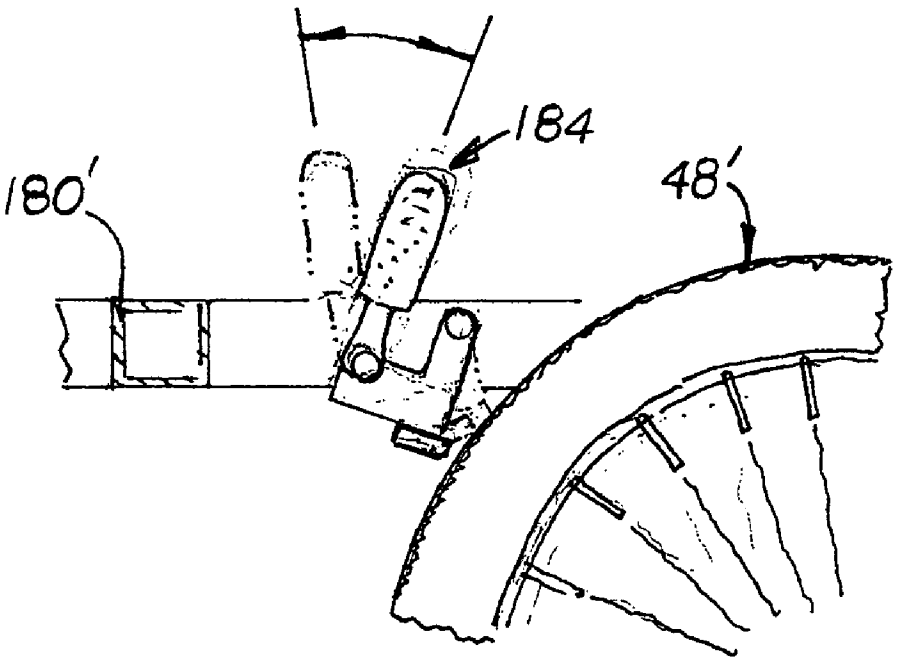
FIG. 8 is a side elevational view of the hand brake.
Figures 9, 10, 11, 12:
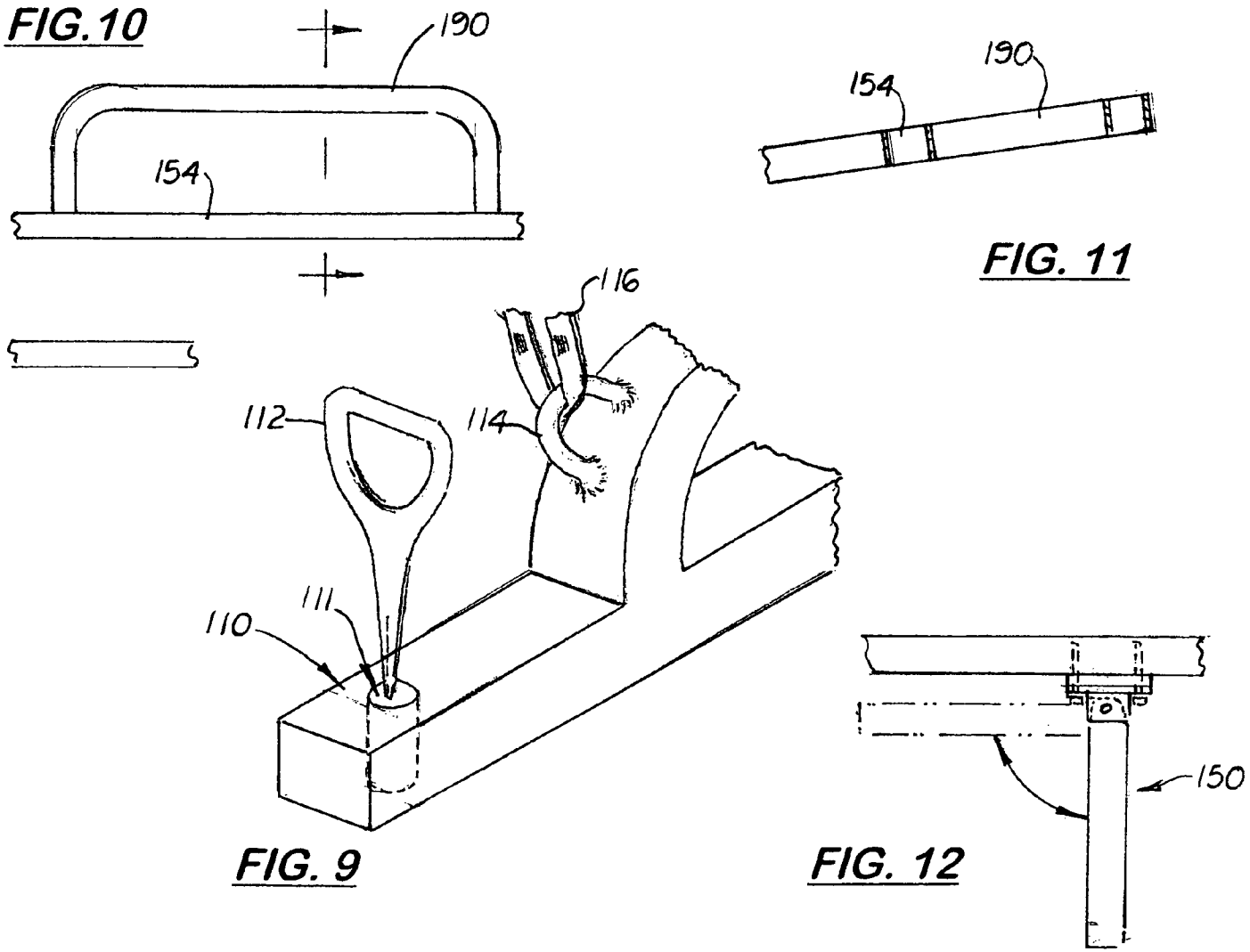
FIG. 9 is a perspective view of the distal end of one side member used in the second embodiment of the invention shown in FIGS. 5 and 6.
FIG. 10 is a top plan view of the handle.
FIG. 11 is a side elevational view of the handle shown in FIG. 10.
FIG. 12 is a rear elevational view of the folding support leg attached to the rear frame member.

In the second embodiment optional U-shaped wheel bars 180, 180' are attached to the lower frame 115 to protect the user's feet when moving the shelter to a new location. As shown in FIG. 8, an optional hand brake 184 may be mounted on the sides of the lower frame member to lock the wheel 48' and prevent movement of the shelter.

In the second embodiment, a first roof panel 170 is disposed between the first and second roof supports 167, 176, respectively. The lower edges of the first roof panel 170 are connected to the upper members 125, 155 on the left and right side frames 121, 151, respectively (see FIG. 6). A second roof panel 179 is disposed between the second roof support 176 and the upper member 135 on the end frame 134. The lower edge of the second roof panel 179 extends downward over the side frames 121,151 and may also be connected to the upper members 125, 155 on the left and right side frames 121,151, respectively. The third roof panel 188 is disposed between the first and third roof supports 167, 185, respectively. The front edge of the third roof panel 188 is securely connected to the third roof support 185.

Attached to the inside surface of the lower frame 115 adjacent to opposite sides of the upper frame members 125, 155 are two optional roof support guides 201, 203, respectively. The roof support guides 201, 203 are used to keep the roof supports longitudinally aligned and stacked over the upper frame members 125, 155 when disposed in a retracted position.

In the preferred embodiment the first and second roof supports 67, 76, 166, 176, are made of 0.025 inch aluminum tubing and approximately 1 inch O.D. The third roof supports 66, 166 are made of 0.062 inch aluminum tubing. The roof and side panels are made of 18 oz. vinyl panel or mesh material. The lower frame members 15, 115 are all made of 0.067 inch aluminum approximately 1 inch O.D.

As mentioned above, the dimensions of the shelter 10 are sufficient to allow a golfer to stand and swing a golf club unencumbered, and to be protected from the weather from the sides and rear. The shelters 10 and 10' each measure approximately 120 inches in length, 72 to 84 inches in width, and 108 to 120 inches in height.

As mentioned above and as shown in the Figs. the side panels 21, 51, 121, 151, and end panels 34, 134, and roof panels 70, 79, 88, 170, 179, 188 are made of nylon or vinyl sheet material. Alternatively, one or more side panels 21, 51, 121, 151, end panels 34, 134, and roof panels 70, 79, 88, 170, 179, 188, may be made of nylon mesh material to allow wind to blow through the shelter 10.

When not in use, the shelter 10, 10' is stored with the roof sections 66, 75, 84, 166, 175, 184 retracted over the lower frames 15, 15'. When inclement weather occurs, the shelter 10, 10' may be manually wheeled by one person to the desired area and the roof sections 66, 75, 84, and 166, 175, 188, respectively, are expanded. The shelters 10, 10' are oriented in the desired area so that the user may view the fairway through the front openings 12, 12'. Optional stakes 112 or weights 117 may be inserted into the ground and around the extensions 110, 110' or around the front wheels 46, 46' to hold the shelter 10, 10' in place during high winds. When the wind becomes excessive, the stakes or weights may be removed and the roof panels 70, 79, 88 and 170, 179, 188, are retracted. The shelters 10, 10' may remain in place or be manually moved to a storage area.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A portable, golf shelter comprising:

a. a three sided lower frame that includes two opposite side frame members and one end frame member, each said side frame member includes a front end;

b. at least one rearward extending, elevated handle attached at an elevated location on said end frame member;

c. at least one wheel permanently affixed to each said side frame member, said wheels being located on said side frame member so that when said front end of each said side frame member rests on the ground, said end frame member is elevated above the ground, said wheels also being attached at a location on said side frame members so that said front ends of said side frame members may be simultaneously lifted off the ground by exerting a downward force on said handle thereby enabling said golf shelter to be easily rolled on said wheels to another location;

d. a first roof support, a second roof support, and a third roof support transversely aligned over said lower frame, said first and second roof supports extending upward and rearward over said lower frame and said third roof support extending upward and forward over said lower frame;

e. means for pivoting connecting the opposite ends of said first, second, and third roof supports to said side frame members thereby enabling said first, second and third roof supports to move between a folded, retracted position and an upright extended position over said lower frame;

f. a retractable panel roof made of flexible sheet material impermeable to water and wind, said roof extends over said lower frame and protect a golfer standing thereunder from inclement weather, said retractable panel roof supported by said first, second and third roof supports when said first, second and third roof support are upward over said lower frame; and, g. at least one air vent formed on said retractable panel roof to allow air to blow through said shelter when said retractable panel roof is extended and used as a shelter.

2. The portable, golf shelter, as recited in claim 1, further including a front extension on at least one said side frame member.

3. The portable, golf shelter, as recited in claim 2, further including a hole formed in said front extension capable of receiving a stake driven into the ground to hold said shelter in place.

4. The portable, golf shelter, as recited in claim 3, further including a support leg mounted on said end frame member, said support leg being selectively extended downward from said end frame member when the shelter is stationary to resistant movement and to keep said end frame member elevated during use as a shelter.

5. The portable, golf shelter, as recited in claim 4, further including at least one brake attached to said lower frame capable of selectively engaging said wheel and preventing said wheel from rolling.

6. The portable, golf shelter, as recited in claim 5, further including wheel bars located around said wheels.

7. The portable, golf shelter, as recited in claim 1, further including a rear end panel made of mesh.

8. The portable golf shelter, as recited in claim 1, further including two side panels each made of mesh.

9. The portable golf shelter, as recited in claim 1, further including at least one roof support guide mounted on said side frame capable of aligning said roof supports in a stack position over said side frame when said roof is retracted on said shelter.

10. The portable golf shelter, as recited in claim 1, further including a pair of front wheels mounted on said lower frame.

11. A portable, golf shelter comprising:

a. a three sided lower frame that includes two opposite side frame members and one end frame member, each side frame member includes a front extension b. at least one wheel affixed at a permanent location to each said side frame member, said wheels being attached at approximately the same locations on said side frame members so that when said shelter is assembled on a flat support surface, each said side frame member is diagonally positioned on the support surface so that said end frame member is elevated above the support surface and said front extensions are positioned on the ground;

c. at least one rearward extending; handle affixed to said end frame member;

d. a first roof support, a second roof support, and a third roof support transversely aligned over said lower frame, said first and second roof supports extending upward and rearward over said lower frame and said third roof support extending upward and forward over said lower frame;

e. means for pivoting connecting the opposite ends of said first, second, and third roof supports to said side frame members thereby enabling said first, second and third roof supports to move between a folded, retracted position and an upright extended position over said lower frame;

f. a retractable panel roof made of flexible sheet material impermeable to water and wind, said roof extends over said lower frame and protect a golfer standing thereunder from inclement weather, said retractable panel roof supported by said first, second and third roof supports when said first, second and third roof support are upward over said lower frame;

h. at least one air vent formed on said retractable panel roof to allow air to blow through said shelter when said retractable panel roof is extended and used as a shelter.

i. two ground stakes used to selectively attached each said extension to the ground.

j. two adjustable straps connected between each said side walls and aid third roof section to prevent said roof from retraction during high wind conditions, and;

j. a support leg attached to said end frame member that may be selectively adjusted to hold said end frame member is an elevated position above the support surface and to resistant movement during use as a shelter.

12. The portable, golf shelter, as recited in claim 11, further including at least one brake attached to said lower frame capable of selectively engaging said wheel and preventing said wheel from rolling.

13. The portable, golf shelter, as recited in claim 11, further including wheel bars located around said wheels.

* * * * *